United States Patent [19]

Tremblay

[11] 4,192,903

[45] Mar. 11, 1980

[54] TWO PIECE ORNAMENT

[75] Inventor: Joseph A. Tremblay, Riverside, R.I.

[73] Assignee: The Lorac Company, Providence, R.I.

[21] Appl. No.: 948,769

[22] Filed: Oct. 2, 1978

[51] Int. Cl.[2] ..... A47G 33/08

[52] U.S. Cl. ..... 428/8; 428/3; 428/11

[58] Field of Search ..... D11/121, 125–129; 40/124.1, 539, 411, 538; 46/31, 35, 36, 37, 157; 229/92.8; 428/3, 7, 8, 9, 11, 16, 43

[56] References Cited

U.S. PATENT DOCUMENTS

| | | | |
|---|---|---|---|
| D. 150,511 | 8/1948 | O'Brien | D11/125 |
| D. 160,174 | 9/1950 | Janowitz | D11/125 |
| 1,695,307 | 12/1928 | Wilson | 428/7 X |
| 1,703,438 | 2/1929 | Wilson et al. | 428/8 |
| 2,081,893 | 5/1937 | Lozier | 428/11 |
| 2,613,140 | 10/1952 | Hart | 428/11 X |
| 2,616,199 | 11/1952 | Robins | 428/9 |
| 4,087,576 | 5/1978 | Patterson | 428/8 |

*Primary Examiner*—Henry F. Epstein
*Attorney, Agent, or Firm*—Salter & Michaelson

[57] ABSTRACT

A decorative ornament construction is disclosed in which two substantially flat sheets are adapted to be interconnected so as to form a three-dimensional ornament capable of being suspended and thus useful as a Christmas tree decoration or the like. One of the sheets is centrally slotted so as to receive the other sheet in intersecting relation while the other sheet is provided with a pair of spaced seats for the support of said one sheet. Generally, the periphery of the sheets each define a similar design configuration such that the ornament presents a substantially uniform three-dimensional appearance.

10 Claims, 11 Drawing Figures

TWO PIECE ORNAMENT

BACKGROUND AND SUMMARY OF THE INVENTION

This invention relates to ornaments and particularly those formed from interconnected substantially flat sheets such that the sheets interconnect with each other along a common juncture line with the several sides thereof outwardly radiating therefrom. In this way, two dimensional sheets are transformed into a composite three-dimensional ornament. Normally, interconnecting tongues and slots are provided in the configuration of the sheets such that they may be interconnected and thereafter soldered, glued or otherwise maintained in their final three-dimensional decorative attitude.

Such completed composite ornaments have the disadvantage of requiring substantial space during shipment as well as requiring care to insure that the thus interconnected pieces do not become broken or otherwise separated during such handling. Accordingly, it would be advantageous to be able to ship the separate sheets forming such composite ornament while disconnected and lying flat against each other inasmuch as this would avoid the undesirable characteristics of the prior art devices above referred to. Such would, however, require that sheets be easily interconnected with each other to form the composite ornament once they had been shipped to the user thereof. It is to such an improved ornament construction that the present invention is directed. The above prior art discussion constitutes applicant's Prior Art Statement.

It is accordingly a primary object of the present invention to provide a composite ornamental construction including a pair of sheets adapted to be shipped flat and then assembled in interconnected position in an easy yet secure manner. These and other objects of the present invention are accomplished by an ornament comprising first and second sheets having opposed substantially planar surfaces, each said sheet having a peripherally defined ornamental outline. The first sheet includes a vertically orientated continuous slot centrally disposed relative thereto so as to divide said first sheet into laterally opposite sides, said slot further respectively terminating at upper and lower ends thereof in upper and lower generally narrow connecting bridges each in turn including a lower edge, said bridges in turn connecting said opposite sides of said first sheet together. The second sheet also has laterally opposite sides disposed to both sides of a vertically orientated central portion which terminates at upper and lower opposite ends thereof in upper and lower opposite ends thereof in upper and lower downwardly recessed pockets, each of said pockets having a lead-in opening and a base seat disposed vertically below at least portions of said lead-in openings, said base seats adapted to receive and support the lower edges of said upper and lower bridges of said first sheet. The vertical distance between said base seats is generally equal to that between the lower edges of said upper and lower connecting bridges of said first sheet slot, said sheets adapted for disposition substantially at right angles to each other along a juncture line formed by the intersection of said slot and said centrally disposed second sheet portion, such that said respective opposite sides of said sheets radiate outwardly from said juncture line when said sheets are interconnected with said first sheet suspended by said second sheet.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
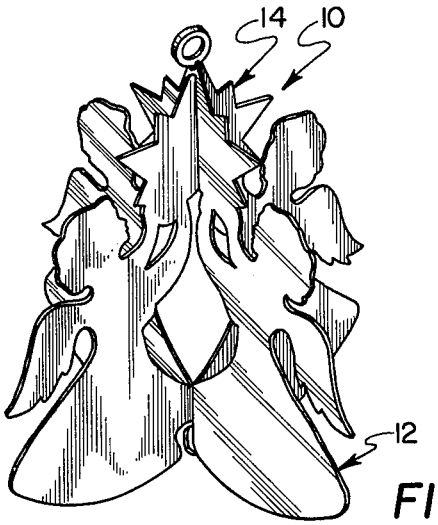
FIG. 1 is a perspective view of a composite ornament which includes the features of the present invention.
Figure 2:
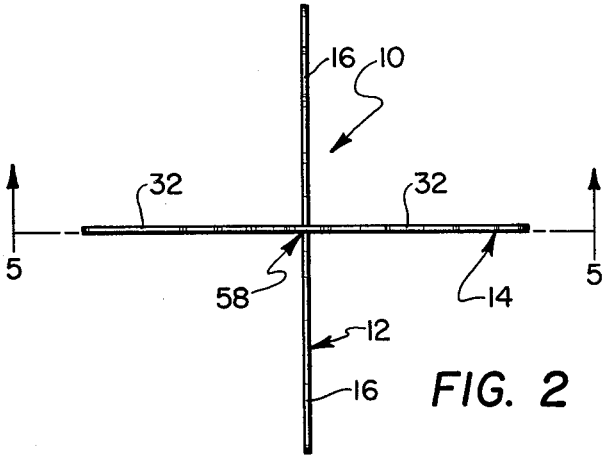
FIG. 2 is a top plan view thereof.

Turning now to the drawings and particularly FIGS. 1 and 2 thereof, the ornament 10 of the present invention is shown in assembled interconnected form. Such composite ornament is formed from the assembly or interconnection of a first sheet 12 and a second sheet 14. The sheets are each of substantially planar configuration and preferably also of a similar overall peripheral design or configuration. Both sheets 12, 14 include laterally opposite sides, each of which forms a part of the overall composite design, such as the single angel design or configuration depicted.

The sides 16 of the first sheet are disposed laterally opposite a centrally disposed vertically orientated slot 18 which extends a major portion of the vertical extent thereof. In the particular first sheet configuration illustrated, a pair of angels are interconnected to each other at top and bottom portions thereof so as to define a central opening 20, which central opening forms a portion of the slot 18. Such interconnection between the laterally opposed sides 16 of the first sheet is by means of a lower connecting bridge 22 and an upper connecting bridge 24, both of generally narrow vertical extent. The upper bridge 24 includes a lower edge 25 proximate the slot 18 and a secondary slot 26 on the opposite or upper edge thereof. The lower connecting bridge 22 includes an upper edged 27 and a lower edge 28, which lower edge forms a portion of the outer lower peripheral edge 30 of such first sheet 12.

The second sheet 14 is of an overall configuration similar to the first sheet 12, that is, it includes laterally opposed similarly configured sides 32 separated by a vertically orientated centrally disposed second sheet portion 34 which may be partially interrupted by an open central portion 36 similar to portion 20 of the first sheet 12. The opposite ends of the central portion 34 terminate in a lower pocket 38 and and upper pocket 40. The lower pocket 38 includes an upper edge 39, a seat 42 and a lead-in portion or opening 44 connecting such pocket 38 with the outer lower peripheral edge 46 of such second sheet 14. A hook portion or extension 48 in part defines the lower seat 42 and extends a short distance thereabove for a purpose which will hereinafter be apparent. The upper pocket 40 includes an upper seat 50 and a lead-in opening 52 in part defined by an extension 54 having an eyelet 56 formed therein for subsequent suspension of the assembled ornament.

Figure 3:
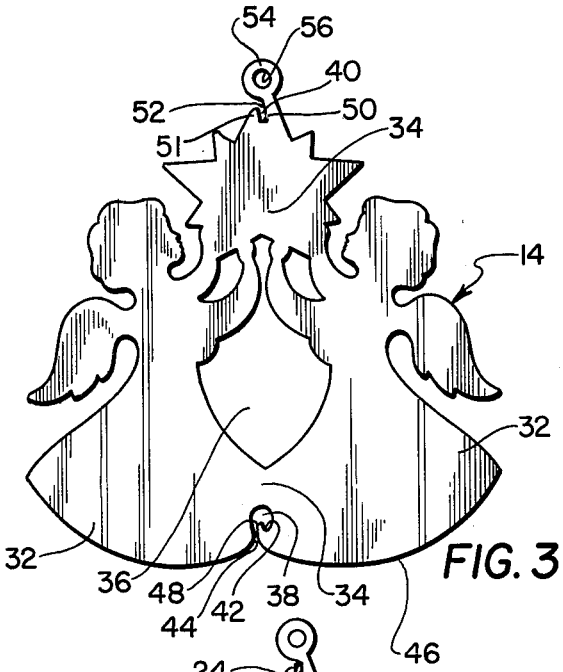
FIG. 3 is a side elevational view of one of the sheets forming such composite ornament shown in FIG. 1.
Figure 4:
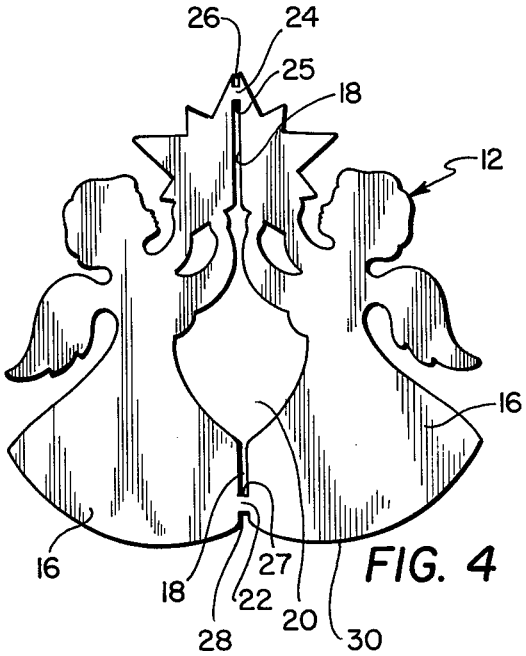
FIG. 4 is a side elevational view of the other sheet forming the composite ornament in FIG. 1.
Figure 5:
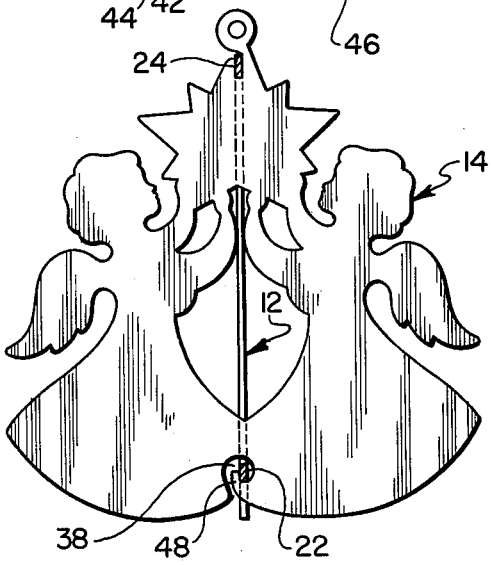
FIG. 5 is a sectional view taken along the line 5—5 of FIG. 2.

With reference to FIG. 5 of the drawings, it should be noted that the interconnection between the sheets 12 and 14 is by disposing the bridges 24 and 22 respectively into the upper and lower pockets 38 and 40 wherein the lower edges 25 and 28 of the bridges 24 and 22 respectively engage the base seats 50 and 42. In this regard, the vertical distance between the lower edges 25 and 28 of the bridges 24 and 22 approximately equals the vertical extent between the seats 42 and 50. Also, it is necessary that once interconnected, the sheets 12 and 14 remain in such position, and for this reason the segments of the sheet 14 are so disposed so that the seats 42 and 50 are undercut, that is, are positioned downwardly from adjacent portions of the second sheet 14 such that the bridges 22 and 24 of the first sheet 12 contact such adjacent portions when the two sheets are engaged in assembled relationship to each other. The adjacent portion of the lower pocket 38 is the hook or finger extension 48, while in the upper pocket 40, such adjacent portion is formed by a portion of the star configuration as illustrated at 51 in FIG. 3.

Figure 6:
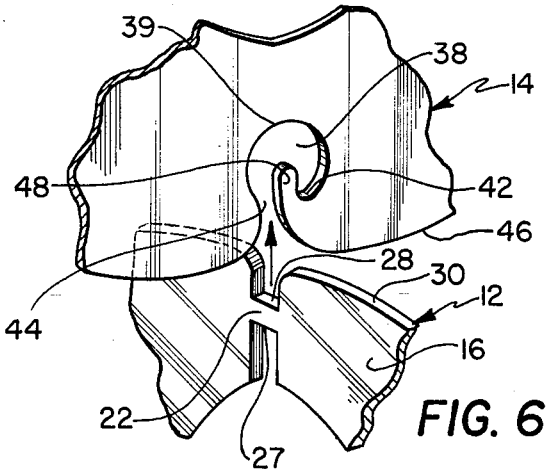
FIG. 6 is a partial perspective view showing the manner in which the sheets may be initially pivotally interconnected with relationship to each other.
Figure 7:
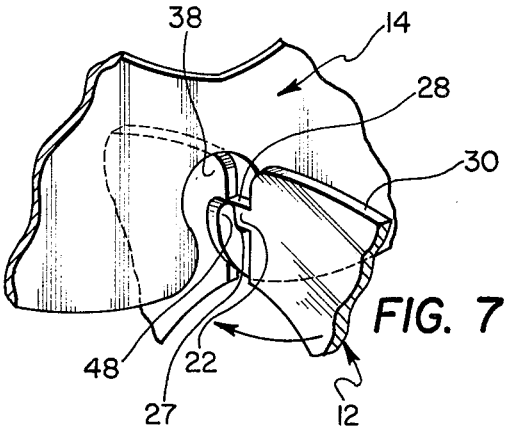
FIG. 7 is a view similar to FIG. 6 showing the sheets after having been pivotally interconnected.
Figure 8:
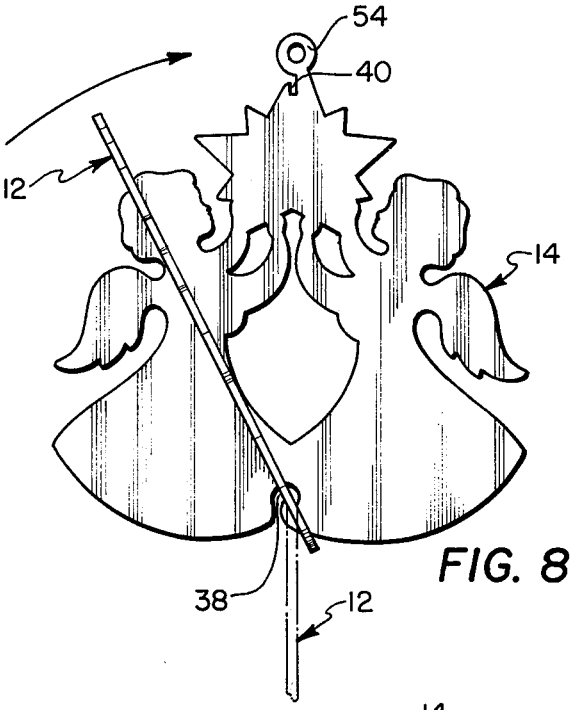
FIG. 8 is a side elevational view similar to FIG. 3, but showing the other sheet interconnected therewith and moved from the position shown in FIG. 7 arcuately towards the top of the ornament.
Figure 9:
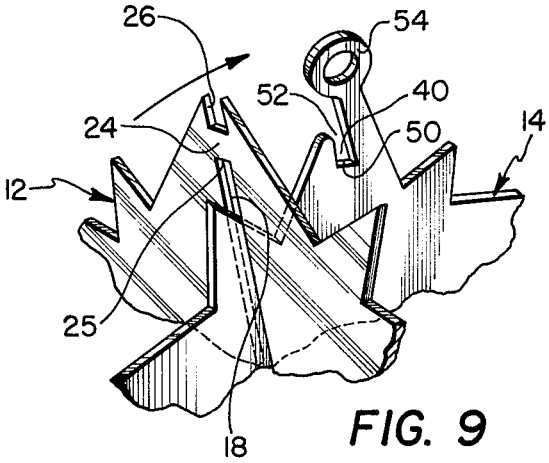
FIG. 9 is an enlarged perspective view showing the manner in which top portions of the sheets may be interconnected.
Figure 11:
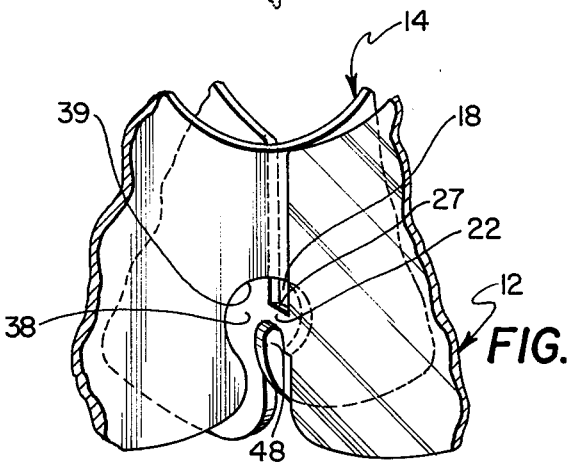
FIG. 11 is a partial perspective view showing the manner in which the bottom of the completed ornament is interconnected.
Figure 10:
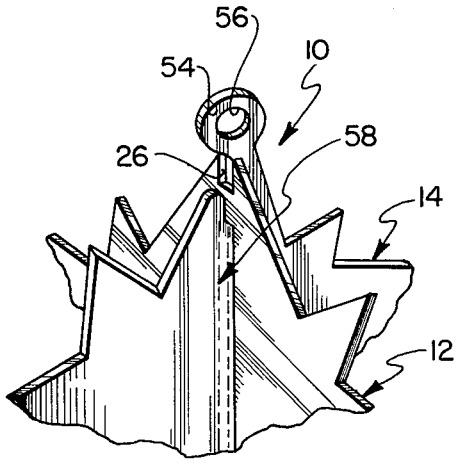
FIG. 10 is a perspective view similar to FIG. 2 showing the completion of such top interconnection.

Interconnection of the two sheets 12 and 14 may be accomplished by the sequential interpositioning of the two sheets as best shown by the transition between FIGS. 6 and 11 of the drawings. Referring to FIG. 6, the sheets are held in substantially perpendicular relationship with the first sheet held upside down so that the bottom peripheral edge 30 of the first sheet 12 is disposed towards the pocket 38 of the second sheet 14. Thereafter, the first sheet is moved vertically upward in the direction of the arrow such that the lower connecting bridge 22 of the first sheet passes through the lead-in opening 44, into the pocket 38 and thence into the position shown in FIG. 7 wherein the upper edge 27 of the lower connecting bridge 22 engages the base seat 42. Thereafter, the first sheet 12 is pivotally swung in relationship to the second sheet 14 in the direction of the arrow shown in FIGS. 7 and 8, it being clear that in such movement the left hand side of the second sheet 14 as viewed in the drawings is free to pass through the slot 18. As the first sheet rotates in the general clockwise position illustrated, its pivotal contact with the pocket 38 via the bridge 22 shifts from contact between the upper edge 27 and the seat 42 to contact between the lower edge 28 and the seat 42. As best shown in FIG. 9, as such pivotal movement continues, the upper connecting bridge 24 will also move through the lead-in 52 into the upper pocket 40 of the second sheet 14 such that the lower edge 25 of such bridge will rest upon the upper seat 50.

Since as previously indicated, the distance between the lower edges 25 and 28 is generally equal to the extent between the seats 50 and 42, in order for the bridge to pass into the undercut or downwardly positioned pocket 40, it is necessary for the pivotal contact between the bridge 22 and the lower pocket 38 to at least momentarily shift such that the upper edge 27 thereof contacts the uppermost edge 39 of the pocket 38. Thereafter, once the bridge 24 has entered the pocket 40 by moving past the uppermost portion 51, the lower edge of the bridge 22 drops down to once again contact with the seat 42 as shown in FIG. 11. Also, the relative length of the slot 18 and the distance between the seats 42 and 50 may be such that the first sheet is supported by contact between only one of either of the bridge lower edges and its respective seat. It may thus be seen that the assembled composite ornament 10 includes separate sheets 12 and 14 thereof which are disposed at substantially right angles to each other along a composite juncture line 58 such that the individual sides 16 and 32 thereof appear to outwardly radiate from said juncture line. In such assembled position, the ornament 10 may be suspended as by the eyelet 56 or may rest upon the respective lower edges 30 and 46 of the sheets 12 and 14.

When suspended, it may be apparent that the extension 54 in which the eyelet 56 is formed, is positioned above and substantially in line with the central juncture line 58 so as to obtain a relative balance to the overall ornament so that it will not cant to one side or the other. In this regard, the secondary slot 26 formed in the top of the first sheet 12 is in line with the central slot 18 and separated therefrom by the upper connecting bridge 24 such that the extension 54 may pass therethrough while the upper bridge 24 is passing into the pocket 40.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An ornament comprising first and second sheets having opposed substantially planar surfaces, each said sheet having a peripherally defined ornamental outline, said first sheet including a vertically orientated continuous slot disposed relative thereto so as to divide said first sheet into laterally opposite sides, said slot further respectively terminating at upper and lower ends thereof in upper and lower connecting bridges each in turn including a lower edge, said bridges in turn connecting said opposite sides of said first sheet together, said second sheet also having laterally opposite sides disposed to both sides of a vertically orientated second sheet portion in turn respectively terminating at upper and lower opposite ends thereof in upper and lower pockets, an adjacent portion of said lower pocket of said second sheet being a hook or finger extension means, each of said pockets having a lead-in opening and a base seat disposed vertically below at least the uppermost surface portions of its corresponding lead-in opening, at least one of said base seats adapted to receive and support the lower edge of said corresponding bridge of said first sheet, the length of said slot being greater than the distance between the uppermost surfaces of said lead in openings and the distance between said base seats being equal to or greater than the distance between the lower edges of said first sheet bridges, said sheets adapted for disposition substantially at right angles to each other along a juncture line formed by the intersection of said slot and said second sheet portion such that said respective opposite sides of said sheets radiate outwardly from said juncture line when said sheets are interconnected with said first sheet supported by said second sheet.

2. The ornament of claim 1, said lower pocket lead-in opening upwardly extending from the lower peripheral edge of said second sheet and said upper pocket lead-in opening downwardly extending from the upper peripheral edge of said second sheet.

3. The ornament of claim 1, said first sheet connecting bridges being generally narrow.

4. The ornament of claim 1, said pockets being downwardly received and both of said base seats being vertically disposed below said uppermost portions of their respective lead-in openings.

5. The ornament of claim 1, said vertical distance between said base seats being substantially equal to the vertical dimension between the lower edges of said bridges and wherein said lower edges simultaneously contact both said base seats.

6. The ornament of claim 1, said second sheet including means for suspending said second sheet, said suspending means extending above said upper pocket and in part defining said upper pocket.

7. The ornament of claim 6, said suspending means being an eyelet.

8. The ornament of claim 1, the sides of each of said sheets being of substantially similar and generally equal size peripheral configuration.

9. The ornament of claim 8, said sides each defining a similar ornamental design, the designs of each sheet interconnected solely at upper and lower portions thereof whereby the intermediate section of each sheet is open, said first sheet slot in part defined by said open intermediate section thereof.

10. The ornament of claim 1, the lower edge portions of each of said sheet sides terminating in a common plane whereby the assembled ornament may be supported in an upright position by said lower edge portions.

* * * * *